US005365968A

United States Patent [19]

Mills

[11] Patent Number: 5,365,968

[45] Date of Patent: Nov. 22, 1994

[54] APPARATUS FOR FLUID DRAINAGE

[76] Inventor: Frederick Mills, 17 Burnell Road, Esh Winning, Durham, United Kingdom, DH7 9PB

[21] Appl. No.: 35,753

[22] Filed: Mar. 24, 1993

[30] Foreign Application Priority Data

Mar. 24, 1992 [GB] United Kingdom ..... 9206343

[51] Int. Cl.[5] ..... B65B 3/04; F16K 51/00

[52] U.S. Cl. ..... 137/312; 141/114; 220/571; 222/108

[58] Field of Search ..... 137/312; 141/114, 282, 141/337; 220/571, 573; 222/108

[56] References Cited

U.S. PATENT DOCUMENTS

| | | | |
|---|---|---|---|
| 3,337,418 | 8/1967 | Halacy, Jr. | 137/312 |
| 4,313,457 | 2/1982 | Cliff | 137/312 |
| 4,450,855 | 5/1984 | Hills | 137/312 |
| 4,603,432 | 7/1986 | Marino | 137/312 |
| 4,633,899 | 1/1987 | Lord | 137/312 |
| 4,809,734 | 3/1989 | Cliff | 137/312 |
| 4,819,681 | 4/1989 | Hodak | 137/312 |
| 5,099,872 | 3/1992 | Tarvin et al | 137/312 |
| 5,172,718 | 12/1992 | Thornburgh | 132/312 |

*Primary Examiner*—George L. Walton

*Attorney, Agent, or Firm*—Popham, Haik, Schnobrich & Kaufman, Ltd.

[57] ABSTRACT

An apparatus for fluid drainage formed of a flexible waterproof material such as a rubber and which has a first end with a cut terminating in a hole to surround a water supply for example a pipe. The hole is surrounded by a elongate reinforcement portion and the second end of the apparatus also has an elongate portion disposed along a portion of the periphery of the apparatus at this second end. The two elongate portions direct and form a barrier for the water flow enabling catchment of a flow of water and direction of the water in a predetermined direction for collection.

12 Claims, 5 Drawing Sheets

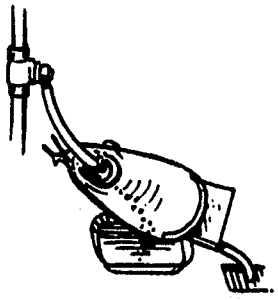
Fig. 4a
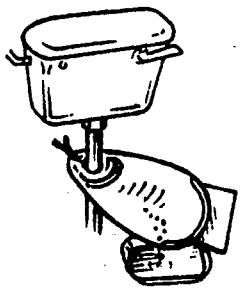
Fig. 4b
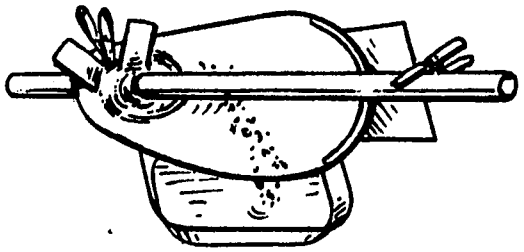
Fig. 4c
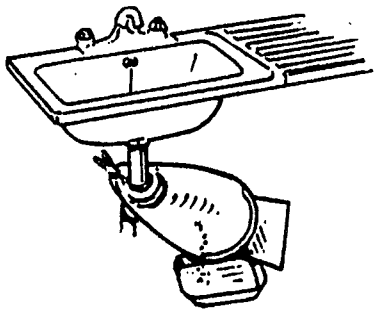
Fig. 4d
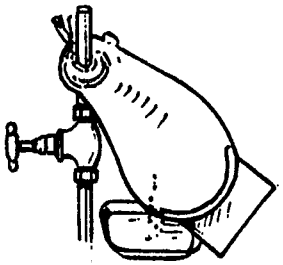
Fig. 4e
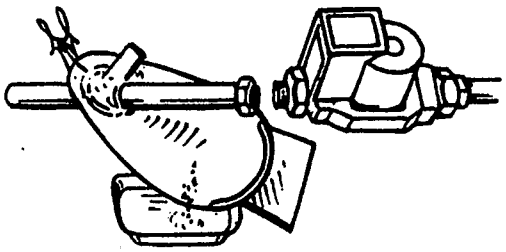
Fig. 4f
Fig. 4g

APPARATUS FOR FLUID DRAINAGE

This invention relates to an apparatus for fluid drainage.

BACKGROUND OF THE INVENTION

From time to time most heating radiators have to be drained or bled either for normal maintenance or to allow the radiator to be disconnected and removed.

One of the major difficulties involved in this process is the disposal of the waste water which is drained from the radiator. It is extremely difficult, due to the shape of a radiator and its close proximity to walls and floors and the positioning of the piping, to place any sort of standard container under the radiator which could catch this water.

This frequently results in a messy spillage of dirty water onto the floor and wall coverings, which can be expensive to rectify. Consequently, the introduction of an apparatus which could direct the water flow out of the radiator into a standard container such as a basin without allowing any spillage would constitute a considerable advantage.

SUMMARY OF THE INVENTION

The present invention provides an apparatus for fluid drainage comprising a sheet of flexible waterproof material, having means at one end to surround a water supply line, such as a pipe, to provide a substantially water-tight seal around the supply line, and having at least one elongate reinforcing portion spaced from said means such that, when said means is positioned around the supply line, the apparatus is formed into a shape which enables catchment of a flow of water and direction of the water in a predetermined direction for collection.

Preferably, the means to surround a water supply line is in the form of a cut in the waterproof material terminating in a hole.

Preferably, the elongate reinforcing portions are of rubber or plastic material.

Alternatively, the elongate reinforcing portions are formed of metal wire which can be selectively deformed to mould the apparatus to a desired shape.

Preferably, the apparatus includes two elongate reinforcing portions, the first elongate portion substantially encircling the hole in the apparatus and the second elongate portion disposed along a portion of the periphery of the apparatus.

Preferably, there is a ridge running across the apparatus at the opposite end from said means to act as a barrier to water flow and direct the water flow in a predetermined direction.

The two elongate portions may be raised from the waterproof material to act as a director of the water flow. In this way, the second elongate portion and the ridge may be formed in one piece.

The flexible waterproof material may be moulded rubber. Alternatively, the flexible waterproof material may be Neoprene or PVC Plastisol.

Preferably, securing clips are provided to attach the apparatus to radiators and other bodies and to add extra rigidity to the apparatus when attached to a supply line.

BRIEF DESCRIPTION OF THE DRAWINGS

Embodiments of the invention will now be described by way of example, with reference to the accompanying drawings, in which:

FIG. 4*a* to 4*g* are perspective views of different applications of the apparatus of the present invention.

DESCRIPTION OF PREFERRED EMBODIMENTS

Figure 1A:
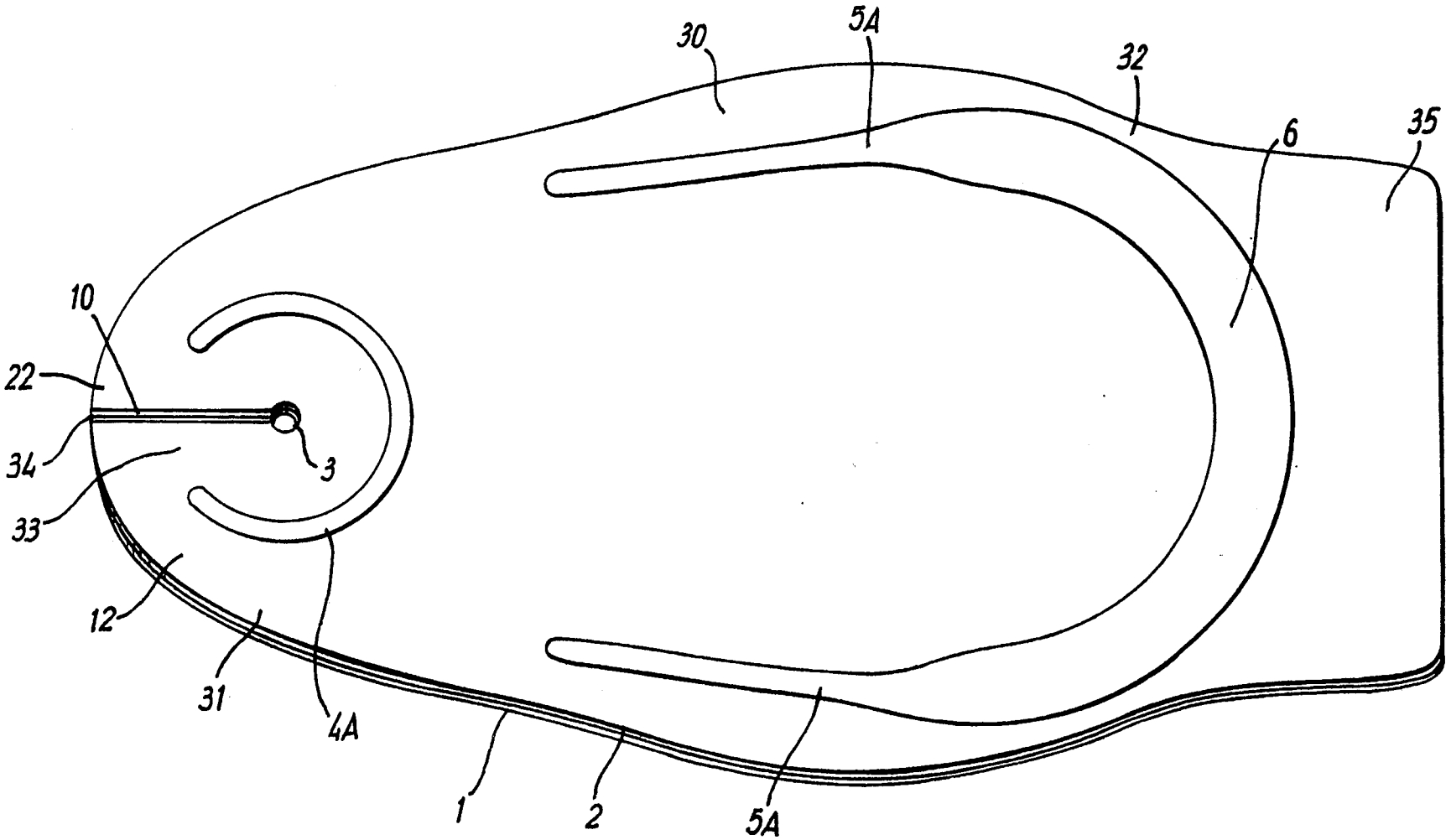
FIG. 1*a* and 1*b* are plan views of two embodiments of an apparatus for fluid drainage in accordance with the present invention, wherein the elongate reinforcing portion is formed from rubber of plastic.
Figure 1B:
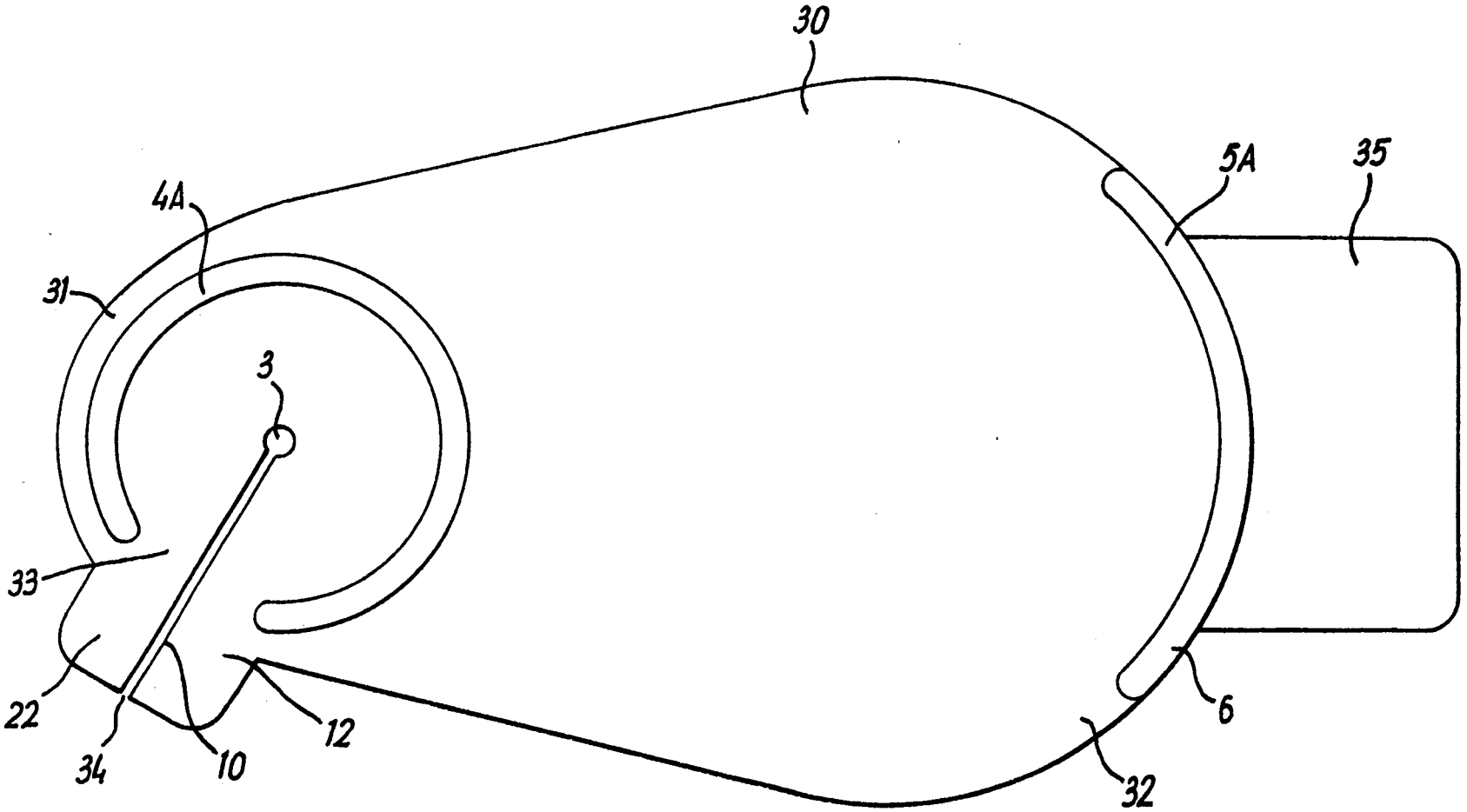

With reference to the drawings FIG. 1*a* and 1*b* illustrates a first embodiment of the apparatus, wherein the apparatus is formed of a moulded rubber material in the form of a generally oval flat plate 30 with a tapered first end 31. The first end 31 has a slit 10 terminating in a small circular hole 3. The hole 3 is encircled by an elongate portion 4*a* in the form of a raised ridge of moulded rubber which is raised on both surfaces of the plate 30. The encircling ridge 4*a* has a break 33 at the point of the slit 10 entry within the ridge 4*a*. Extension flaps 12, 22 are provided at either side of the exit 34 of the slit 10.

The second end 32 of the plate 30 also has an elongate portion 5*a* in the form of a raised ridge of moulded plastic, raised on both surfaces of the plate 30. The raised ridge 5*a* at the second end 32 is arcuate and defines a portion of the curved edge of the second end 32 of the plate 30. Both of the raised ridge areas 4*a*, 5*a* have an oval cross sectional. The raised ridge 5*a* at the second end 32 of the plate 30 is of a greater height from each surface of the plate 30 to that of the encircling ridge 4*a*. The raised ridge 5*a* at the second end 32 of the plate 30 acts as a barrier to the water flow, whereas the encircling ridge 4*a* primarily acts as a director of the water flow.

The second end 32 of the plate has an extension flap 35 extending from the second end 32. This extension flap 35 and the two extension flaps 12, 22 either side of the slit exit 34 at the first end 31 of the plate 30 provide an area for attachment of a clip 8 to the apparatus in order to attach the apparatus to a radiator 11 or pipe 7. The clips are metal sprung toothed clips of sufficient width to grip a pipe 7.

Figure 2:
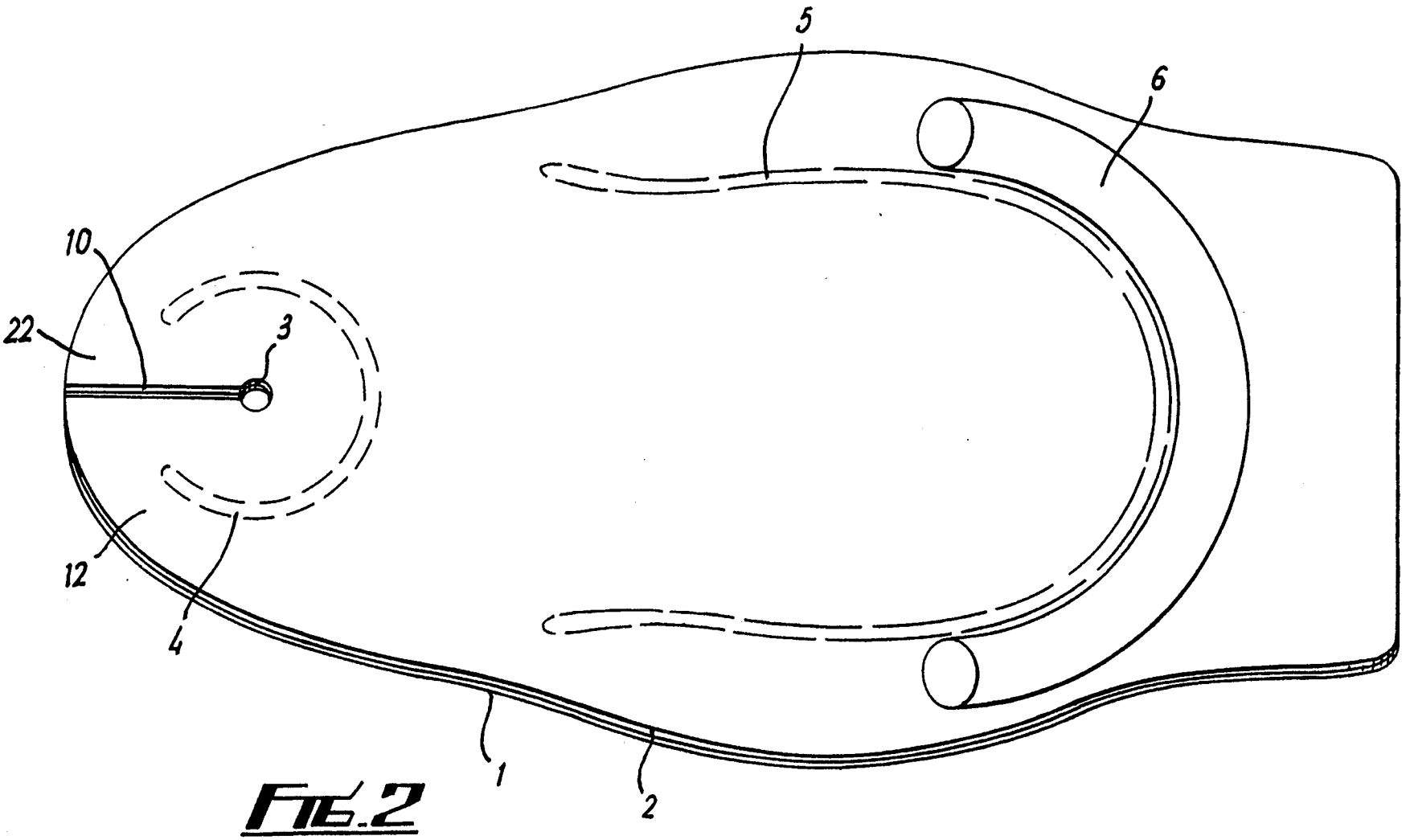
FIG. 2 is a plan view of an apparatus for fluid drainage in accordance with the present invention, wherein the elongate portion is a metal wire.
Figure 3:
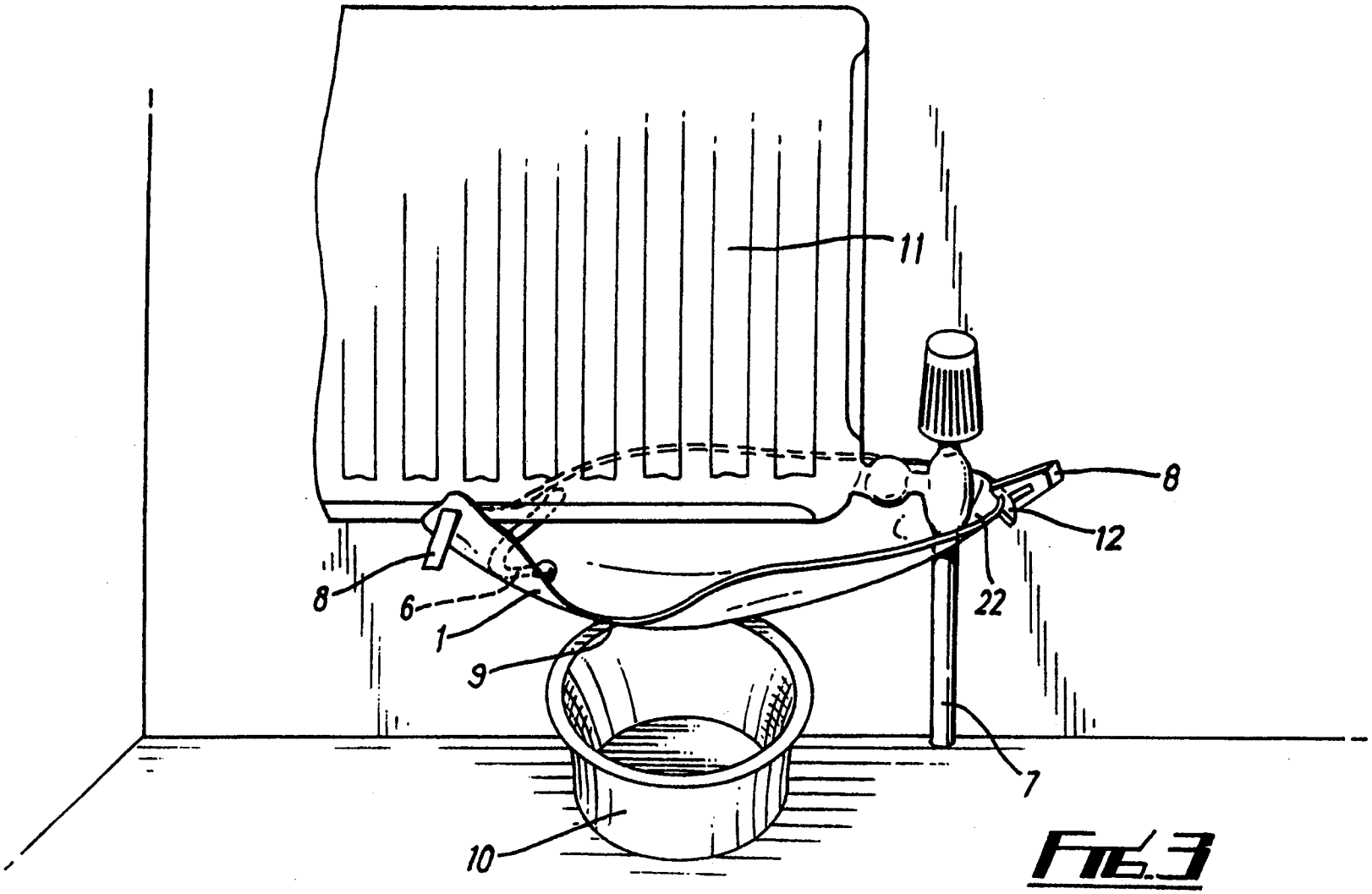
FIG. 3 is a perspective view of the apparatus for fluid drainage in use.

FIG. 2 illustrates an alternative form of the apparatus, wherein the apparatus for fluid drainage is formed from two identical flat pieces of rubber 1 and 2 which are glued together. A slit 10 is also cut in one end of this apparatus terminating in a small circular hole 3.

Two long pieces of flexible wire 4 and 5 are encased by the two pieces of rubber 1 and 2. The first wire 4 encircles the hole 3 and terminates on either side of the slit 10. The second wire 5 runs substantially along the periphery of the apparatus in an approximately U-shaped form.

A cylindrical rubber element is affixed to the top surface of the apparatus at the opposite end from the slit 10 forming a ridge 6 on the surface.

In use, the apparatus is attached to the bottom of a radiator 11, which is to be drained, by first pushing the slit 10 over a pipe 7 to which the radiator 11 is attached, until the pipe 7 is received by the hole 3. Two pieces of the apparatus 12 and 22 on either side of the slit 10 are then overlapped. The apparatus thus provides a substantially water-tight seal around the pipe 7. The elongate portion 4 or 4*a* ensures that the apparatus maintains its shape and a securing clip 8 can be attached to the apparatus if extra rigidity is considered to be necessary.

Water escaping from the pipe 7 above the apparatus is thus directed to the centre of the apparatus and the ridge 6 acts as a barrier to water flow from the opposite end of the apparatus and helps to direct the water to the edge of the apparatus at a predetermined point 9.

The second elongate portion 5 or 5*a* enables the remaining part of the apparatus to be moulded around the radiator 11 so as to direct the flow of water outward at the predetermined point 9 and into a standard container such as a basin 10.

A second securing clip 8 can be used to attach the apparatus to the radiator 11 if necessary. The apparatus thus allows the controlled direction of a flow of water out of a pipe 7 to a predetermined position 9 for collection.

The apparatus could likewise be used in other situations (illustrated in FIGS. 4*a* to 4*g*) such as a draincock (FIG. 4*a*), WC cistern drain off (FIG. 4*b*), horizontal pipe leak (FIG. 4*c*), vertical pipe leak (FIG. 4*d*), waste outlet (FIG. 4*e*), rising main stopcock (FIG. 4*f*) or water pump replacement (FIG. 4*g*).

Modifications and variations of the above described embodiment can be adopted without departing from the scope of the invention.

We claim:

1. An apparatus for fluid drainage comprising:

a sheet of flexible, waterproof material having an opening at one end for surrounding a water supply line and providing a substantially water-tight seal around the water supply line, and having at least one elongate, reinforcing portion positioned about a portion of said sheet and being spaced from said opening for deforming said sheet into a specific configuration defining a barrier for allowing a collection of leaking fluid when said opening is positioned around the water supply line and for directing the leaking fluid from said water supply line in a predetermined direction to an edge of said sheet at a predetermined point thereon, which is determined by said configuration for collection into a container, said sheet having its other end secured to a device to be drained and said reinforcing portion being intermediate said ends.

2. The apparatus of claim 1 wherein:

said opening has an elongated slit portion extending inwardly from an outer edge of said sheet of flexible, waterproof material and terminating in a circular hole portion.

3. The apparatus of claim 2 wherein:

said at least one elongate, reinforcing portion includes a first elongate, reinforcing portion substantially encircling said circular hole portion, and a second elongate, reinforcing portion spaced from said first elongate, reinforcing portion and disposed along an outer, peripheral portion of said sheet of flexible, waterproof material.

4. The apparatus of claim 3 wherein:

said first and second elongate, reinforcing portions are raised from an upper surface of said sheet of flexible, waterproof material.

5. The apparatus of claim 1 wherein:

said at least one elongate, reinforcing portion is formed from rubber.

6. The apparatus of claim 1 wherein:

said at least one elongate, reinforcing portion is formed from plastic.

7. The apparatus of claim 1 wherein:

said at least one elongate, reinforcing portion is formed from deformable metal wire.

8. The apparatus of claim 1 wherein:

a ridge is disposed along an end of said sheet of flexible, waterproof material opposite from the end having an opening, whereby leaking fluid is directed in a predetermined direction by said ridge.

9. The apparatus of claim 8 wherein:

said ridge forms one of said at least one elongate reinforcing portion.

10. The apparatus of claim 1 wherein:

said sheet of flexible, waterproof material is formed from molded rubber.

11. The apparatus of claim 1 wherein:

said sheet of flexible, waterproof material is formed from a synthetic plastic material.

12. The apparatus of claim 1 further comprising a clip for attaching said sheet of flexible, waterproof material to said water supply line with said opening positioned around the water supply line.

* * * * *